United States Patent [19]

Pitts

[11] 4,400,107

[45] Aug. 23, 1983

[54] SUSPENSION FILES AND BINDERS

[75] Inventor: Warren R. Pitts, Needham, Mass.

[73] Assignee: Dennison Manufacturing Company, Framingham, Mass.

[21] Appl. No.: 229,684

[22] Filed: Jan. 29, 1981

[51] Int. Cl.[3] ..... B42F 13/26; B42F 15/00

[52] U.S. Cl. ..... 402/4; 312/184; 402/70; 402/80 R; 402/80 P; 402/39; 281/15 A

[58] Field of Search ..... 402/39, 80 R, 70–76, 402/4, 80 P; 281/15 A, 15 B; 312/184

[56] References Cited

U.S. PATENT DOCUMENTS

| | | | |
|---|---|---|---|
| 3,885,726 | 5/1975 | Fridlund et al. | 281/15 B X |
| 4,302,123 | 11/1981 | Dengler et al. | 402/80 R |
| 4,315,696 | 2/1982 | Ermanski et al. | 402/70 |

FOREIGN PATENT DOCUMENTS

| | | | |
|---|---|---|---|
| 1486782 | 5/1969 | Fed. Rep. of Germany | 402/70 |
| 1404206 | 5/1965 | France | 402/70 |

*Primary Examiner*—Paul A. Bell

*Attorney, Agent, or Firm*—Arthur B. Moore; George E. Kersey; Barry D. Josephs

[57] ABSTRACT

File folders of the type having hooks to permit suspension for storage, and further including appendages to permit binding or compartmentalization of materials. The folder may contain loose-leaf binding rings, permanently or detachably mounted to the base. Alternatively, the folders are perforated at the base to hold a spiral binder for materials. The folders can be provided with telescoping side members to achieve an accordion-like effect. Such folders may additionally include permanent or removable divider panels.

5 Claims, 8 Drawing Figures

SUSPENSION FILES AND BINDERS

BACKGROUND OF THE INVENTION

The present invention relates to file folders and more particularly to file folders which are suspended for storage.

One well known type of filing system utilizes folders which are adapted to be suspended from one or more supporting rails. Typically, the folder includes hooks for slidably engaging a rail. One popular version of such a filing system includes two parallel carrier rails which suspend hanging files by means of hooks which extend outwardly from opposite sides of the folders.

An illustrative system of this type is disclosed in U.S. Pat. Nos. 2,291,724 and 3,667,854, marketed under the trademark Pendaflex by the Oxford Pendaflex Corp. This filing system enjoys a number of advantages, but is limited in the facility to subdivide filed materials. This system also suffers the limitation that such folders are suitable for storing documents, but not for permanently binding them.

A number of systems have been proposed for adapting ring binders to the carrier rails used in suspension filing systems. Illustrative patents disclosing such binder devices include U.S. Pat. Nos. 3,801,175; 3,936,201; 3,993,374; and 4,208,146. These patents disclose a variety of devices to be adapted to conventional multiple-ring binders in order to permit the user to suspend such binders. All of these devices are limited in that they do not permit the user to store loose documents along with bound documents. Additionally, they are characterized by complex mechanisms which present difficulties in the addition or removal of pages.

Accordingly, it is a principal object of the invention to provide improved suspension files of the type which are stored on a pair of carrier rails. A related object is the adaption of such filing systems to permanent binding of materials.

Another object of the invention is the provision of means for subdividing material stored in files of this type. It is a related object to provide a system which achieves flexibility in establishing categories.

A further object of the invention is the storage of materials both in loose and bound form, at the user's discretion.

SUMMARY OF THE INVENTION

The above and further objects are implemented in the suspension file folders of the invention, which may be adapted to the binding or compartmentalization of materials.

In accordance with one embodiment of the invention, the suspension file folder is joined at its base to a multiple-ring binder. In one version of this embodiment, the binder is permanently joined to the base. In an alternative version, the binder is attached to the folder's base by the user. The binder may be fastened to the base in combination with a backing member, or alternatively clipped onto the base.

A further aspect of the invention relates to the nature of the ring binder mechanism. Each ring advantageously includes two independently manipulated parts. The rings are anchored at ball joints which are cross-sectioned to constrain rotational movement.

In an alternative embodiment of the invention, the file folders are perforated at the base, and engage wire spirals of the type commonly encountered in wire-wound notebooks.

A further embodiment of the invention provides a device for subdividing materials within a given suspension file folder. This embodiment involves telescoping side members which provide an accordion effect, allowing the user to vary the volume of materials contained in a given file folder. In a preferred version of this embodiment, the file folder further includes one or more divider panels attached to the side members. The divider panels may be permanently attached to the side members, or may be removably inserted at a desired location by the user.

BRIEF DESCRIPTION OF THE DRAWINGS

The above and additional aspects of the invention are illustrated in the detailed description which follows, taken in conjunction with the drawings in which.

DETAILED DESCRIPTION

Reference should now be had to FIGS. 1–7 for a detailed description of the suspension file folders of the invention.

Figure 1:
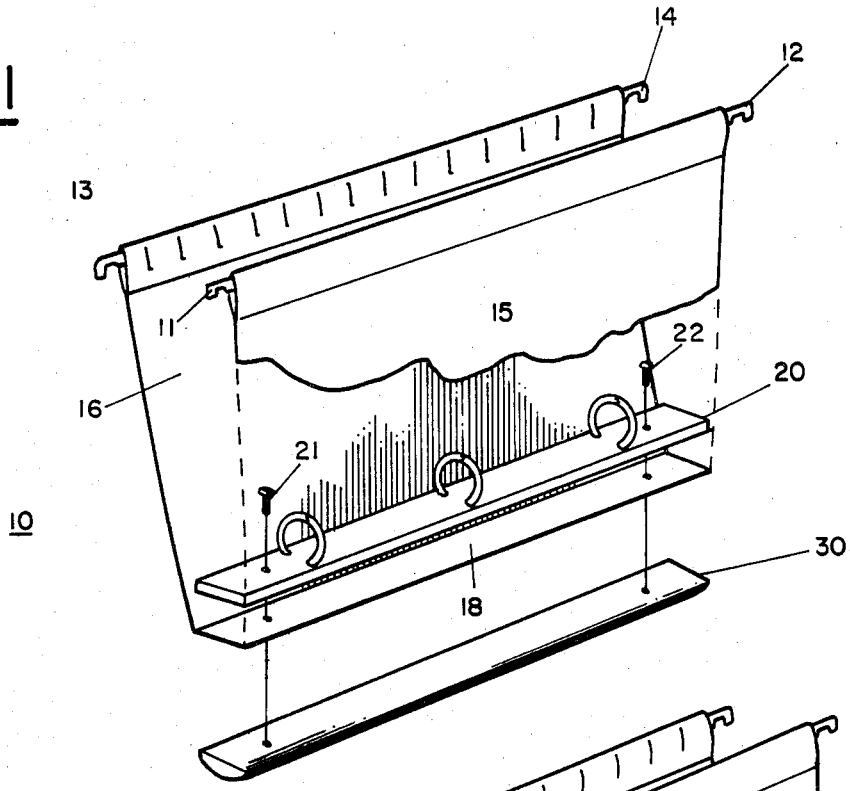
FIG. 1 is a cutaway perspective view of a suspension file binder in accordance with a preferred embodiment of the invention.

With reference to a cutaway view of FIG. 1, file binder 10 comprises a folder which includes leaves 15 and 16 and a base 17. The binder further includes a series of outwardly extending hooks 11–14, by which the folder may be suspended from a pair of carrier rails as known in the prior art. Folder 10 is adapted for permanent binding of documents by the attachment to its base 18 of a three-ring binder 20. In the embodiment of FIG. 1, the binder 20 is attached to the base 18 by fastening it to a backing member 30, for example using screws 21 and 22. This arrangement may be used to removably attach a multiple-ring binder to the base of a folder. Alternatively, the binder may be permanently attached to the folder at its base, for example by rivets.

Figure 2:
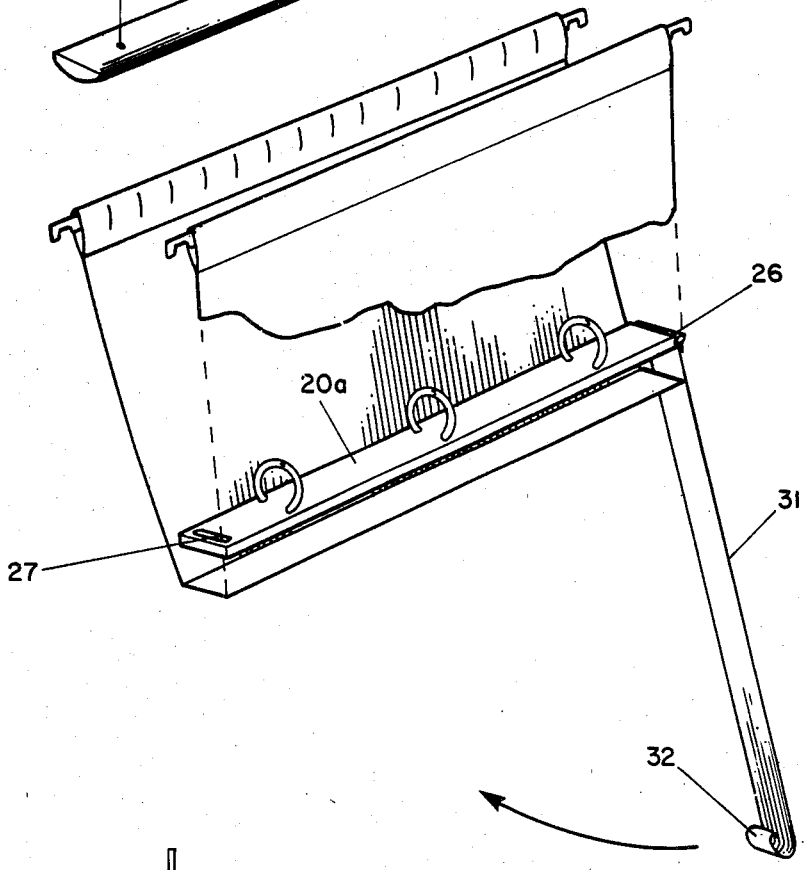
FIG. 2 is a cutaway perspective view of an alternative suspension file binder embodiment.

An alternative folder with three-ring binder is illustrated in FIG. 2. In this view, a binder **20*a* is hinged at 26 to a clip 31, which may be pivoted to provide a backing member similar to the backing member 30 of FIG. 1. In this instance, the tip 32 of clip 31 engages a recess 27 at the end of binder 20*a* opposite to hinge 26**.

Figure 3:
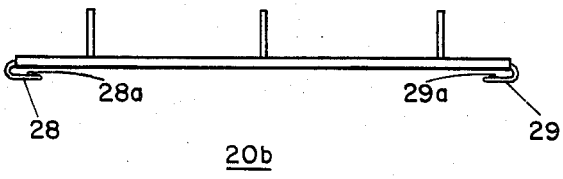
FIG. 3 is a plan view of a three-ring binder attachment in accordance with yet another version of this embodiment.

Yet another variation of the three-ring binder attachment is shown in the plan view of FIG. 3. In this case, the binder **20*b* includes a pair of flexible end clips 28 and 29. These end clips include pawls 28*a* and 29*a* to engage complementary indentations (not shown) in the base 18 of folder 10**.

Figure 6:
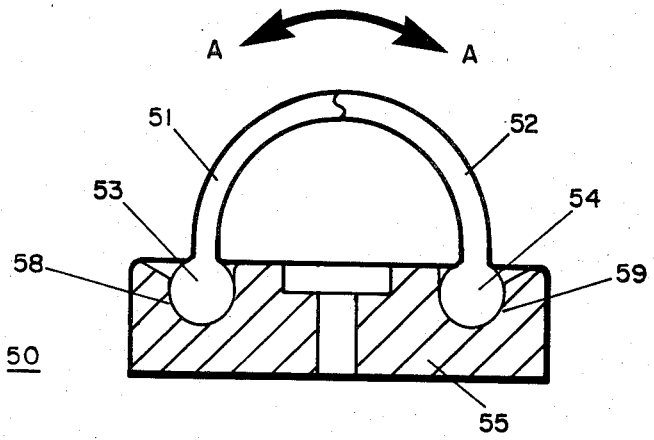
FIG. 6 is a sectional view of a preferred ring binder mechanism.

With reference to the sectional view of FIG. 6, an advantageous design for individual binder rings is shown at 50. The binder ring 50 is bipartite, including prongs 51 and 52, which are individually manipulable by the user in order to open and close the rings. As shown in the preferred embodiment of FIG. 6, the prongs are anchored at ball joints 53 and 54, where they are firmly engaged unless released by the user, as discussed below. Balls 53 and 54 fit in complementary cavities 58 and 59 in base 55. Ball joints 53 and 54 and cavities 58 and 59 are profiled to permit axial pivotal movement after release, as indicated by arcuate arrows A—A, while preventing lateral rotation. This structure may be economically fabricated using molded plastics.

Figure 7A:
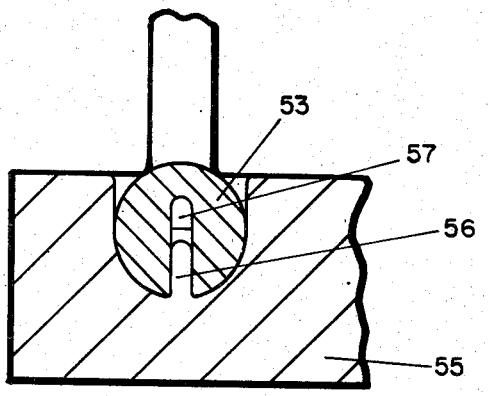
FIG. 7A is an axial sectional view of a ball joint of the ring binder of FIG. 6.
Figure 7B:
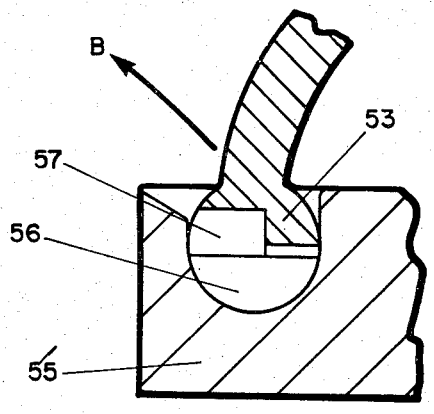
FIG. 7B is a transverse sectional view of a ball joint of the ring binder of FIG. 6.

A suitable design for a given ball joint 53 is shown in the sectional view of FIGS. 7A and 7B. As shown in FIG. 7A, ball 53 includes a central axially oriented slot 57, which is mated to a rib 56 extending into cavity 58 from base 55. The dimensions of rib 56, slot 57, and cavity 58 provide a tight fit for ball 53 which prevents any movement of prong 51 during normal usage. When the latter is subjected by the user to a releasing force in direction B, the ball 53 slips free and may then be pivoted axially to separate the prongs and allow addition or removal of pages.

Figure 4:
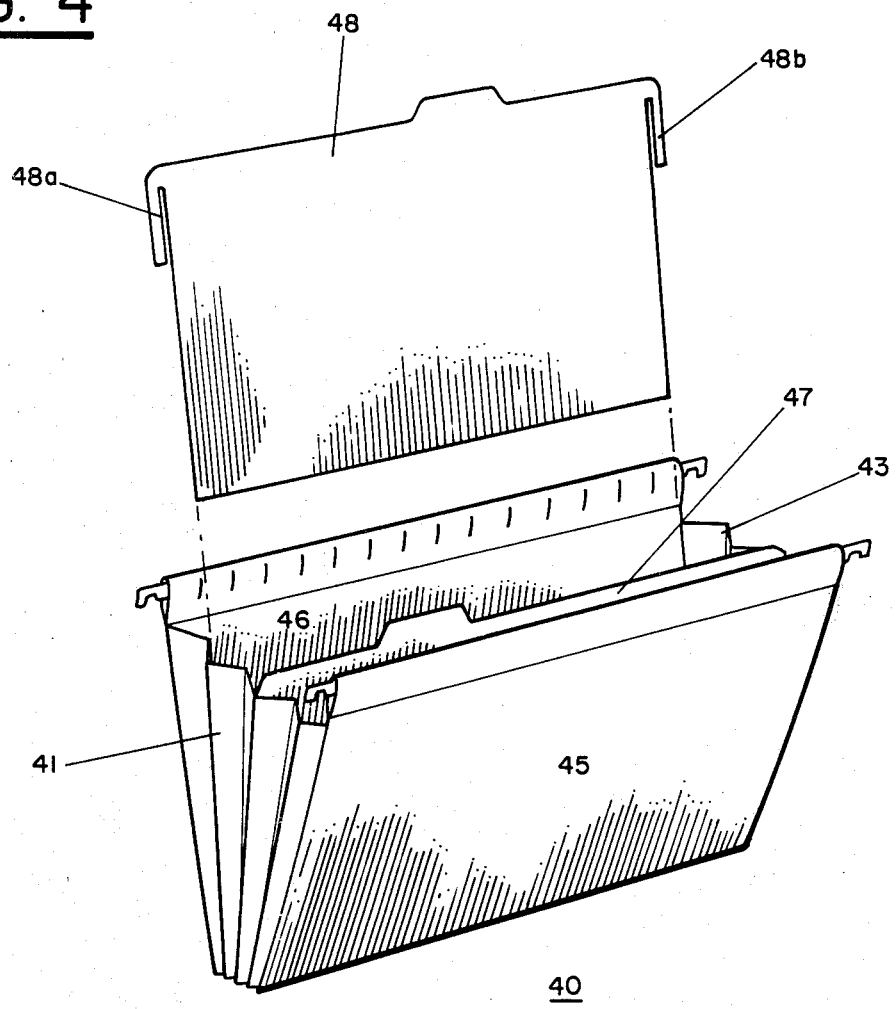
FIG. 4 is a perspective view of an alternative suspension folder embodiment.

A suspension file folder 40 as known in the prior art may be modified so as to provide user control over the volume and subdivision of material, as illustrated at 40 in FIG. 4. The folder 40 includes a pair of opposing side panels 41 and 43 which interconnect leaves 45 and 46. Each side panel comprises a fan-folded structure which is attached at each end to one of leaves 45 or 46. The side panels 41 and 43 may be attached to leaves 45 and 46 during assembly of folder 40, or alternatively may be provided separately with pressure sensitive adhesive strips and attached by the user.

The user may subdivide materials within a given folder 40 using the compartments defined by one or more dividers 47, 48, etc. The divider may be permanently attached at each end to a side member 41 or 43, as shown at 47. Alternatively, the divider may be detachably inserted by the user onto side members 41 and 43 as shown at 48. In the latter case, the divider panel 52 includes a pair of edge slots **48*a*, 48*b*** in order to provide engagement with the side members at a desired location.

Figure 5:
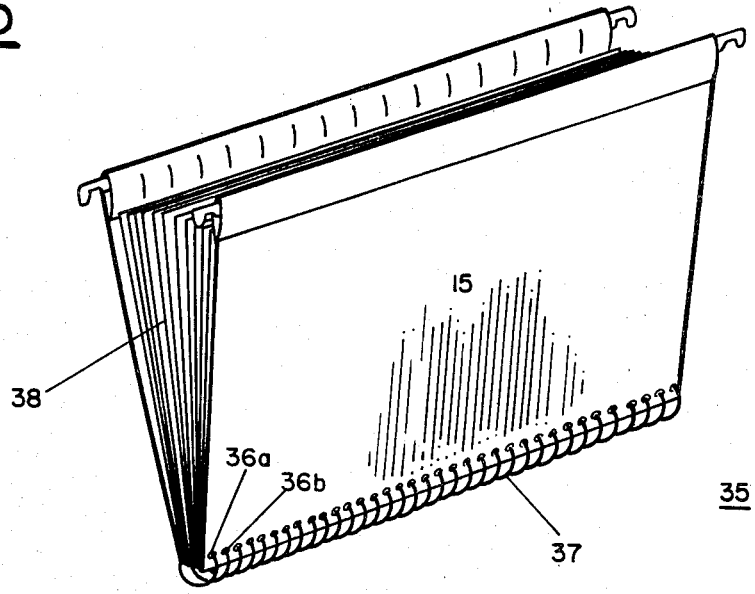
FIG. 5 is a perspective view of a further suspension binder embodiment.

A further suspension file binder design is shown in the perspective view of FIG. 5. A file binder 35 is formed by perforating each leaf 15 and 16 near the base, providing a series of holes **36*a*, 36*b*, etc. at the pitch of a given wire spiral. The wire spiral is inserted through holes 36 and similar holes (not shown) in sheets 38** to permanently bind these sheets.

While various aspect of the invention have been set forth by the drawings and the specfication, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. An improved suspension file folder of the type including a base, a plurality of leaves attached to the base, and at least one hook attached to said leaves in order to suspend the folder from a carrier member, in which the improvement comprises a binder for the document comprising:

a platform of dimensions compatible with the base of said folder, said platform having a hinge at one end;

a plurality of rings mounted on one face of said platform to engage documents; and a backing member pivotally attached to said platform at the hinge, said backing member having a clip to engage said platform at an end opposite said hinge, wherein said platform is inserted within said file folder at the base so that a face of said platform opposite said rings rests against the base, and said backing member is secured to said platform with the base of said folder therebetween.

2. An improved suspension file folder as defined in claim 1, wherein each of said rings comprises a pair of arcuate prongs having a ball at one end, wherein the ball of each arcuate prong is closely fitted to a complementary cavity in said binder appendage.

3. The improved suspension file folder of claim 2 wherein the ball of said prong includes an axially oriented slot which is fitted to a rib protruding into said cavity.

4. An improved suspension file folder of the type including a base, a plurality of leaves attached to the base, and at least one hook attached to said leaves in order to suspend the folder from a carrier member, in which the improvement comprises a binder for documents comprising:

a binder appendage;

a plurality of rings mounted on said binder appendage to engage documents, wherein each of said rings comprises a pair of arcuate prongs having a ball at one end, and wherein the ball of each arcuate prong is closely fitted to a complementary cavity in said binder appendage; and means for attaching said binder appendage to the base of said file folder.

5. The improved suspension file folder of claim 4 wherein the ball of said prong includes an axially oriented slot which is fitted to a rib protruding into said cavity.

* * * * *